US010068559B2

(12) United States Patent
Kober

(10) Patent No.: US 10,068,559 B2
(45) Date of Patent: Sep. 4, 2018

(54) MAGNETIC PICKUP

(71) Applicant: Cölestin Julius Kober, Mondsee (AT)

(72) Inventor: Cölestin Julius Kober, Mondsee (AT)

( * ) Notice: Subject to any disclaimer, the term of this patent is extended or adjusted under 35 U.S.C. 154(b) by 0 days.

(21) Appl. No.: 15/545,594

(22) PCT Filed: Jan. 21, 2016

(86) PCT No.: PCT/AT2016/050009
§ 371 (c)(1),
(2) Date: Jul. 21, 2017

(87) PCT Pub. No.: WO2016/115585
PCT Pub. Date: Jul. 28, 2016

(65) Prior Publication Data

US 2018/0012582 A1 Jan. 11, 2018

(30) Foreign Application Priority Data

Jan. 22, 2015 (AT) ..... A 27/2015

(51) Int. Cl.
*G10H 3/18* (2006.01)

(52) U.S. Cl.
CPC ..... *G10H 3/181* (2013.01)

(58) Field of Classification Search
CPC ..... G10H 3/181; G10H 3/18; G10H 1/32; G10H 2220/471; G10H 3/22; G10H 2220/461; G10D 1/085; G10D 3/10
See application file for complete search history.

(56) References Cited

U.S. PATENT DOCUMENTS

| | | | | |
|---|---|---|---|---|
| 2,764,052 A | 9/1956 | McBride | | |
| 4,378,722 A | 4/1983 | Isakson | | |
| 4,499,809 A | 2/1985 | Clevinger | | |
| 4,624,172 A * | 11/1986 | McDougall | G10H 3/181 | 84/726 |
| 5,206,449 A | 4/1993 | McClish | | |
| 2006/0117938 A1 * | 6/2006 | Gillette | G10H 3/185 | 84/723 |

(Continued)

FOREIGN PATENT DOCUMENTS

| | | | |
|---|---|---|---|
| DE | 608559 | 1/1935 | |
| JP | S5520549 | 2/1980 | |
| WO | WO 2016115585 A1 * | 7/2016 | G10H 3/181 |

OTHER PUBLICATIONS

International Preliminary Report on Patentability and Written Opinion, Application No. PCT/AT2016/050009, 9 pages, Jul. 5, 2017.

(Continued)

*Primary Examiner* — Marlon Fletcher
(74) *Attorney, Agent, or Firm* — FisherBroyles, LLP

(57) ABSTRACT

A magnetic pickup is configured for a stringed instrument with at least one string, a neck part, and a body, which has a soundboard. A north and south pole of the magnetic pickup define a magnetic axis. The magnetic axis of the magnetic pickup is oriented substantially parallel to the soundboard or, in the region of the magnetic pickup, an auxiliary magnet having a magnetic axis is arranged, the magnetic axis of the auxiliary magnet is oriented substantially parallel to the soundboard or at a right angle to the magnetic axis of the magnetic pickup.

12 Claims, 9 Drawing Sheets

(56) References Cited

U.S. PATENT DOCUMENTS

| | | | | |
|---|---|---|---|---|
| 2006/0144208 | A1* | 7/2006 | Kandrack | G10D 1/085 84/290 |
| 2006/0150806 | A1 | 7/2006 | Hara | |
| 2007/0084335 | A1* | 4/2007 | Silzel | G10H 3/143 84/723 |

OTHER PUBLICATIONS

Search Report for Corresponding Austrian Application No. A 27/2015, 1 page, May 21, 2015.

* cited by examiner

MAGNETIC PICKUP

CROSS-REFERENCE TO RELATED APPLICATIONS

This application is a National Stage application of International Application No. PCT/AT2016/050009, filed Jan. 21, 2016, which claims priority to Austrian Application No. A27/2015, filed Jan. 22, 2015, which are incorporated by reference herein in their entireties.

BACKGROUND

Field

The invention relates to a magnetic pickup for a stringed instrument with at least one string, the stringed instrument comprising a neck part and a body which comprises a soundboard, and the north and south poles of the magnetic pickup defining a magnetic axis.

Related Art

Known electric stringed or bowed instruments, especially electric violins or electric guitars, have the disadvantage of providing a relatively weak, interference-prone and distorted pickup signal, which does not permit high-quality signal and sound processing.

SUMMARY

For this reason, it is the object of the invention to provide a magnetic pickup of the initially mentioned kind, with which a stronger pickup signal and thus a higher signal-to-noise ratio can be achieved in the sensed signal.

According to the invention, this is achieved by

- the magnetic axis of the magnetic pickup being oriented substantially in parallel to the soundboard or by
- an auxiliary magnet with a magnetic axis being provided in the region of the magnetic pickup, the magnetic axis of the auxiliary magnet being oriented approximately in parallel to the soundboard or at a right angle to the magnetic axis of the magnetic pickup.

In the first variant of the invention, the magnetic pickup with its magnetic axis is aligned so that the latter is situated in the vibration plane of the respective string, which the bow causes to vibrate substantially in parallel to the soundboard. Accordingly, the signal generated in the magnetic pickup element of the invention reaches high signal strength.

In the second alternative variant, an auxiliary magnet is used to generate a magnetic field component in the vibration plane of the respective string and to thus achieve a stronger inductive effect in the magnetic pickup of the invention.

Both variants of the invention allow for higher signal strength and thus less influence from interfering signals, and for high fidelity.

A further development of the first variant of the invention may be that the magnetic axis of the at least one magnetic pickup is oriented substantially at a right angle to the string to guarantee that the generated signal is as high and undistorted as possible.

Another exemplary embodiment of the first variant of the invention may be that the stringed instrument has two or more strings and that the one or more magnetic pickups is/are each arranged between respective two of the strings, with its/their magnetic axis being situated in parallel to the soundboard and thus in the vibration plane of the strings.

The magnetic pickup may comprise a cylindrical permanent-magnet core with a coil wound around the magnetic core for picking up a signal, with the cylinder axis being the magnetic axis, with the coil being incorporated in a solenoid body formed by a cylindrical tube segment with end flanges, and with the cylindrical permanent-magnet core being arranged in the tube segment of the solenoid body.

Preferably, in the first variant of the invention, the magnetic pickup may be arranged in such a way as to protrude from the soundboard or the fretboard, thereby achieving a suitable orientation of the magnetic axis of the magnetic pickup.

In another embodiment of the first variant of the invention, the magnetic pickup or the magnetic pickups may be attached to the fretboard or partly inlaid therein so that the magnetic axis—when viewed in a cross-section—is oriented substantially in parallel to the tangent to the respective part of the curved surface of the fretboard.

In this way, the magnetic axis of the respective magnetic pickup is essentially oriented in such a way as to be situated in the vibration plane of the string the bow has caused to vibrate, whereby a very strong and undistorted pickup signal can be generated.

In contrast thereto, another advantageous development of the second variant of the invention may be that the magnetic pickup is embedded in a recess of the soundboard or the fretboard underneath the at least one string, and that a protruding holder is arranged laterally of the at least one string, on which holder the respective auxiliary magnet is arranged, whose magnetic axis is oriented substantially in parallel to the soundboard or the fretboard.

This arrangement of an auxiliary magnet protruding from the soundboard allows for a magnetic field component to be generated in the vibration plane of the string the bow has caused to vibrate, so that—due to the additional magnetic field of the auxiliary magnet—a greater strength of the sensed signal may be achieved in the magnetic pickup arranged in the known manner.

In addition, it is advantageous for the magnetic axis of the respective auxiliary magnet to be oriented substantially at a right angle to the string.

According to one preferred exemplary embodiment of the second variant of the invention, the respective auxiliary magnet may be a permanent magnet of preferably cylindrical form so that the cylinder axis is the magnetic axis. In the context of the invention, the auxiliary magnet may also be e.g. an electromagnet.

Furthermore, the invention relates to an electric stringed instrument having one or more magnetic pickups of the invention.

According to a further development of the invention, the electric stringed instrument may be an electric violin, without loss of generality.

BRIEF DESCRIPTION OF THE DRAWINGS

Below, the invention will be described in detail with reference to the exemplary embodiments illustrated in the drawings. The following details are shown.

DETAILED DESCRIPTION

Figure 1:
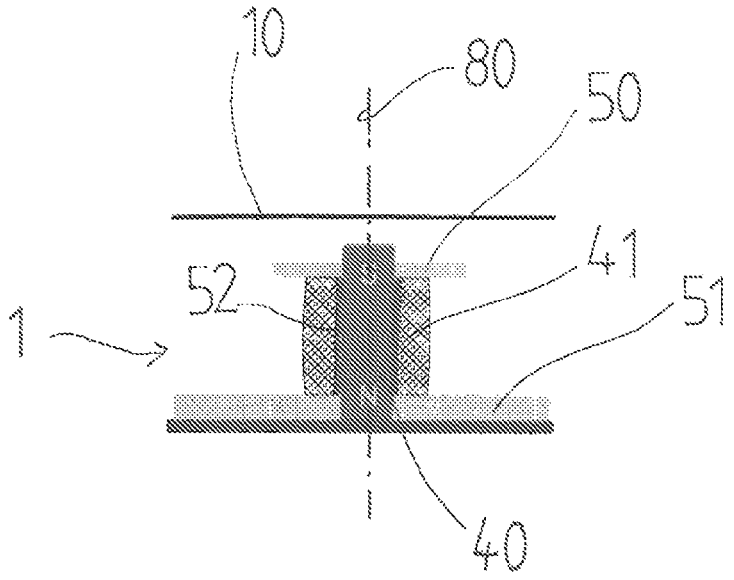
FIG. 1 shows a partial section of a state-of-the-art stringed instrument having a magnetic pickup.

FIG. 1 shows a section of a known electric stringed instrument with a magnetic pickup 1, which is arranged underneath a string 10 and whose north and south poles define a magnetic axis.

Below, the invention will be described by reference to an electric violin as an example of a stringed instrument, without being limited thereto. The invention may, however, analogously be applied, without any limitation, to any stringed instrument or bowed instrument, e.g. a cello, viola, guitar etc. Similarly, the design and the number of strings of the bowed or stringed instrument in which the magnetic pickup of the invention is incorporated is not subject to any limitations. It is also possible for the magnetic pickup of the invention to be incorporated into a stringed or bowed instrument later on.

The magnetic pickup 1 has a cylindrical permanent-magnet core 40 with a coil 41 wound around the magnetic core 40 for picking up a signal, with the cylinder axis 80 being the magnetic axis. On its ends, the magnetic core has opposite magnetic poles S and N, which define the magnetic axis. In this arrangement, the length along the cylinder axis 80 is e.g. smaller than the diameter of the magnetic pickup 1 with the coil 41.

The coil 41 is incorporated in a solenoid body, which is formed by a cylindrical tube segment 52 with end flanges 50, 51, with the cylindrical permanent-magnet core 40 being arranged in the tube segment 52 of the solenoid body. The design of the magnetic pickup illustrated in FIG. 1 is only exemplary and serves to explain functional principles.

The permanent-magnet core produces a static magnetic flux, which flows from the north pole N to the south pole S. When the string 10 vibrates in front of the pole S of the pickup 1, this magnetic flux changes, and a voltage is induced in the coil 41, which voltage is correlated to the string vibration and can be amplified by a subsequent amplifier (not shown).

Figure 2:
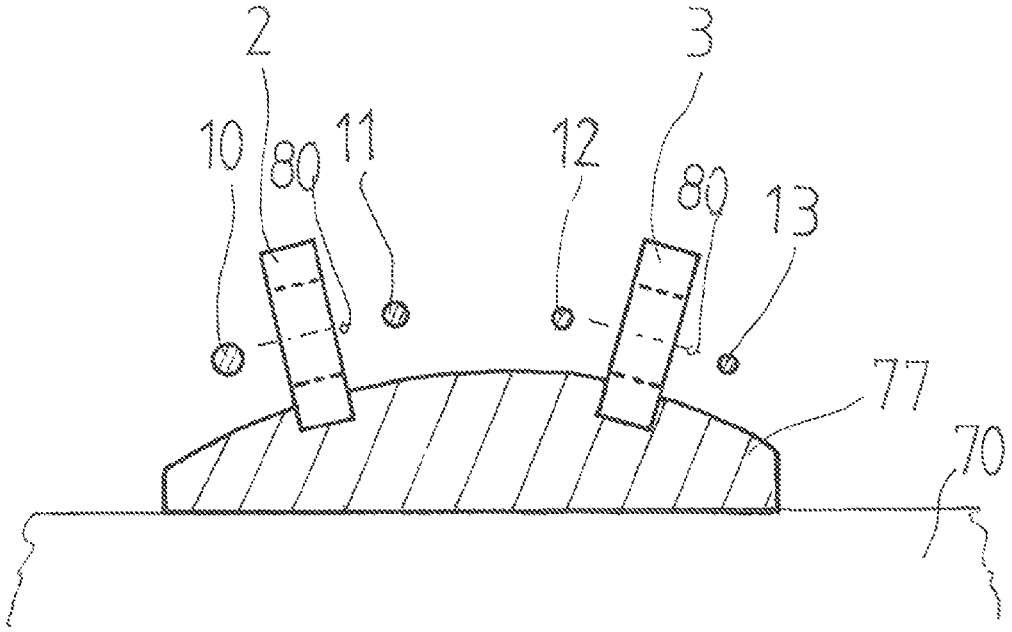
FIG. 2 shows a section perpendicular to the longitudinal axis of one embodiment of the magnetic pickup of the invention.

FIG. 2 shows one embodiment of a stringed instrument, especially of a bowed instrument, in particular of a violin, according to the invention, of which a fretboard 77 is illustrated, above which four strings 10, 11, 12, 13 are stretched.

According to the invention, the magnetic axis 80 of a magnetic pickup 2, 3 is substantially oriented in parallel to the soundboard 70 or to an imaginary tangent to it, whereas a parallel orientation of the magnetic axis 80 and the soundboard 70 is not possible due to the attachment of the magnetic pickup elements 2, 3 to the curved surface of the fretboard 77.

In this way, the magnetic axes 80 of the magnetic pickups 2 and 3, each of which is positioned between two respective strings 10, 11 and 12, 13, are arranged approximately in the vibration plane of the strings 10, 11 and 12, 13 so that a substantially stronger signal can be achieved as compared to the state-of-the-art arrangement according to FIG. 1. Each magnetic pickup 2, 3 may pick up a signal of the nearby vibrating string 10, 11 on each pole side. The magnetic pickup 2, 3 has, along its cylinder axis 80, a length smaller than a distance between two strings 10, 11, whereby the magnetic pickup 2, 3 has relatively small dimensions and allows for a very light design. It is merely necessary to arrange relatively small pickup coils with associated small permanent magnets between or next to the instrument strings, namely substantially above or outside of the soundboard 70, whereby a very easy mounting and a very low weight are possible, with only minor effects on the resonance behavior.

The orientation of the magnetic axes as specified in the invention requires the magnetic pickups 2, 3 to protrude from the soundboard 70 or the fretboard 77. The magnetic pickups 2, 3 are attached to the fretboard 77 by being partially inlaid therein so that the magnetic axis 80—when viewed in a cross-section—is oriented substantially in parallel to the tangent to the respective part of the curved surface of the fretboard 77.

Figure 3:
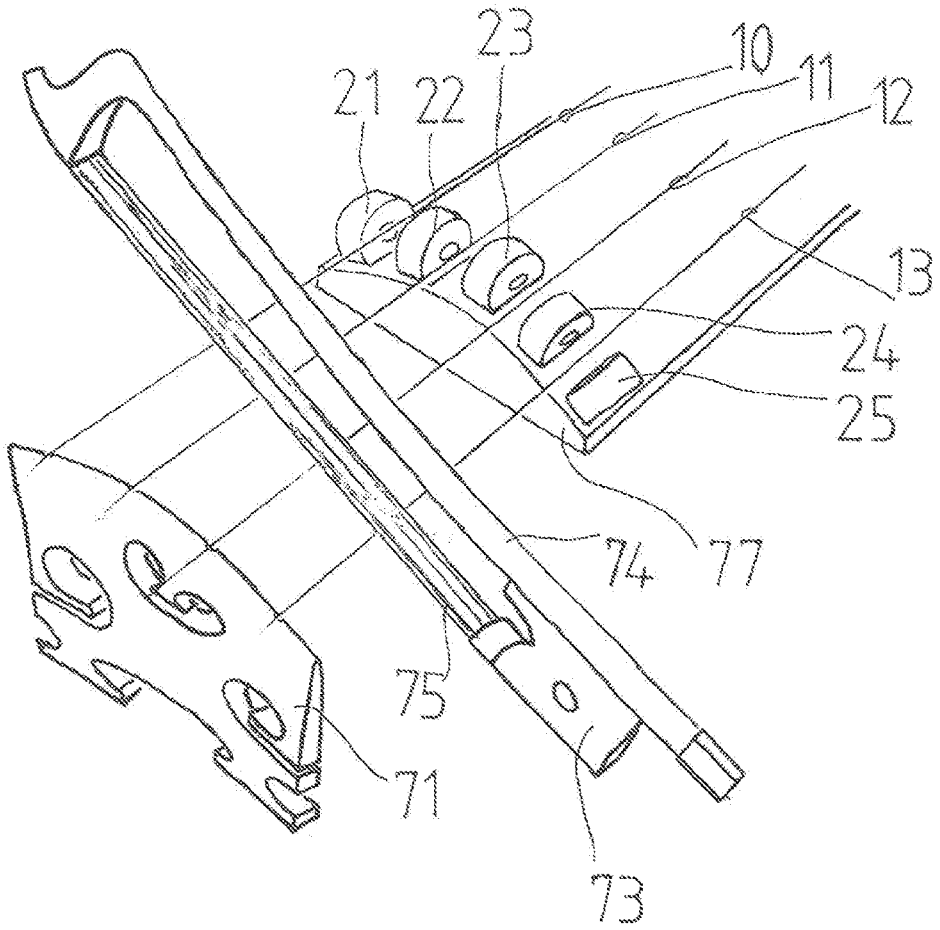
FIG. 3 shows an oblique view of a stringed instrument having another embodiment of the magnetic pickup of the invention.
Figure 4:
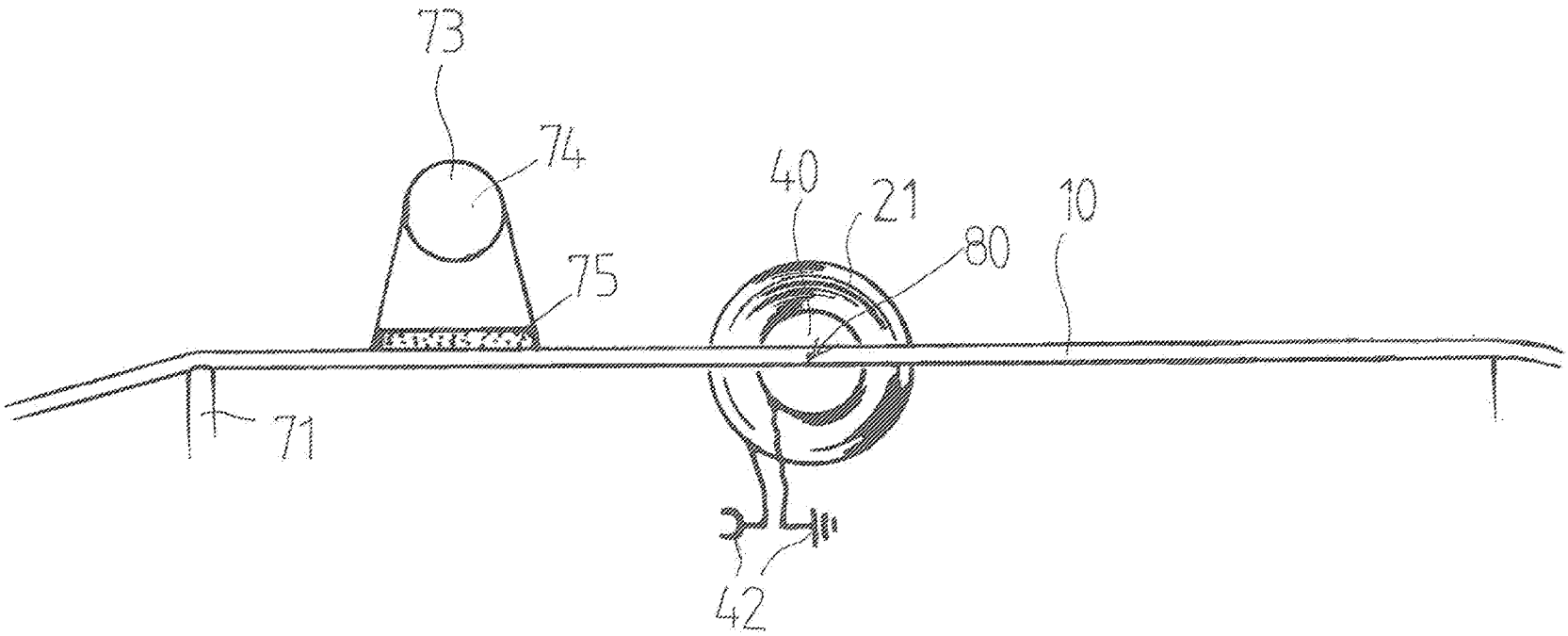
FIG. 4 shows a detail of a lateral view of the stringed instrument of FIG. 3.

In the exemplary embodiment of FIG. 3 to FIG. 7, another violin with four strings 10, 11, 12, 13 is formed, which strings stretch across a bridge 71 and above the fretboard 77. The neck part and the body of the violin are not illustrated. Using a violin bow 73 comprising a stick 74 and bow strings 75, the four strings 10, 11, 12, 13 can be caused to vibrate in an area of the violin that is offset from the magnetic pickups 21, 22, 23, 24, 25 in the longitudinal direction, as can be seen in FIG. 3 and FIG. 3.

Figure 5:
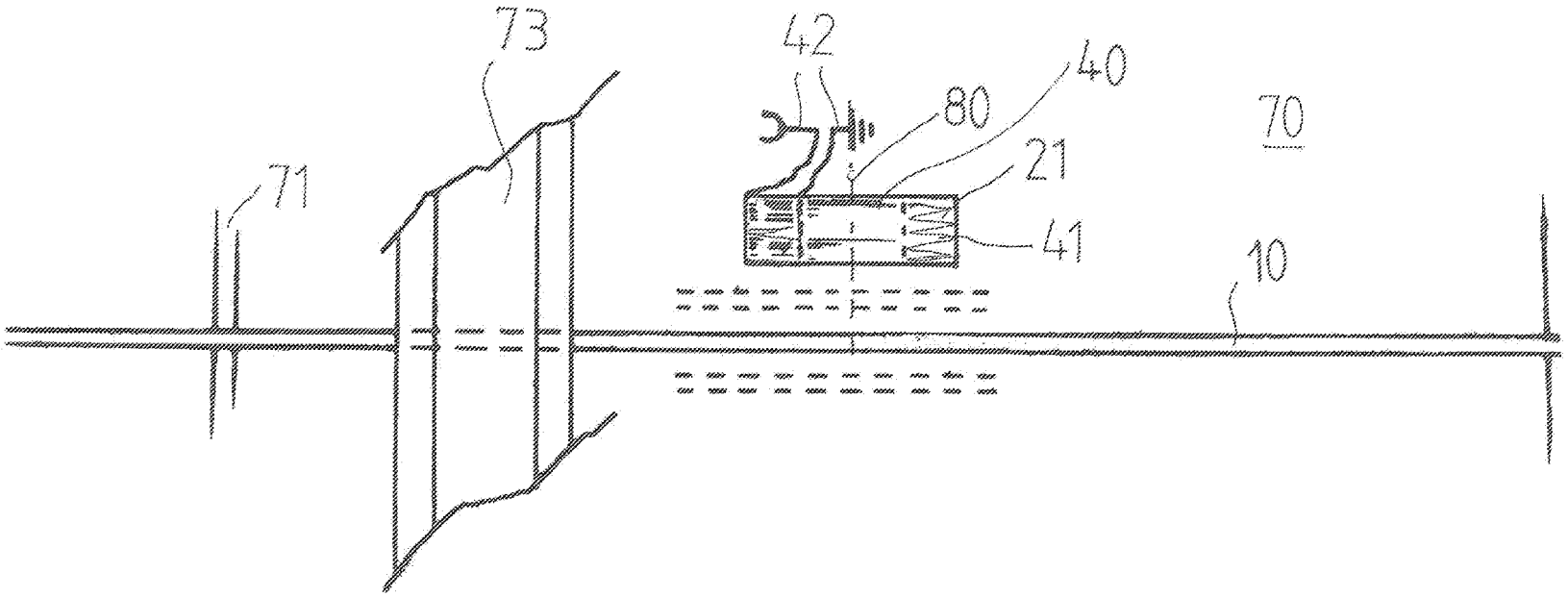
FIG. 5 shows a detail of a top view of the stringed instrument of FIG. 3.
Figure 6:
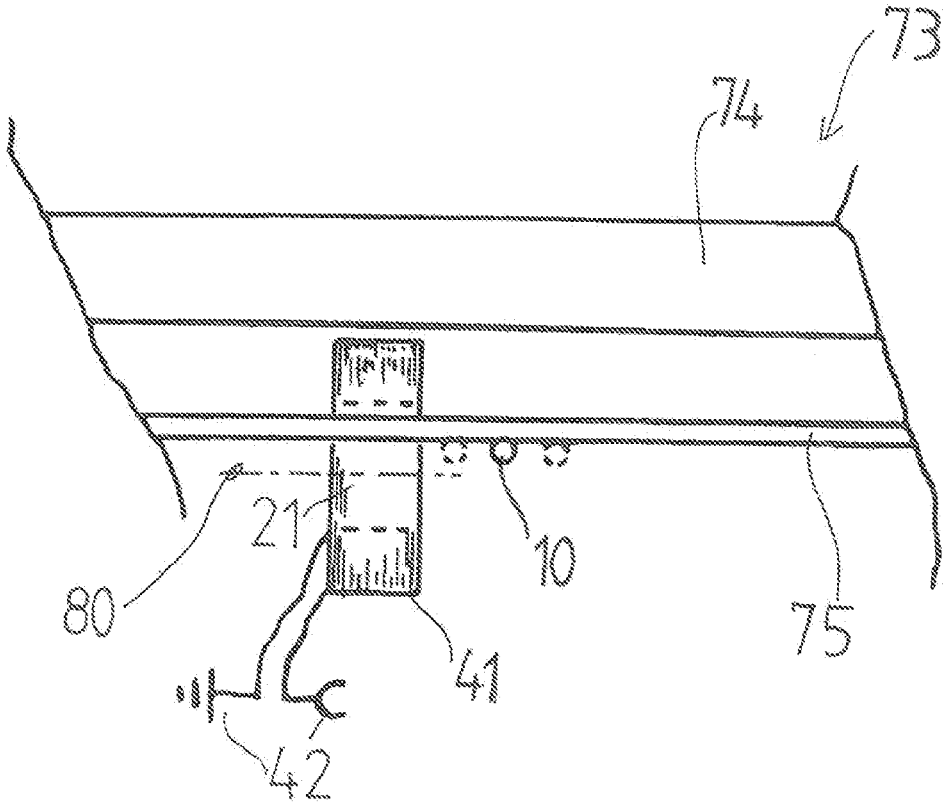
FIG. 6 shows a detail of a sectional view of the stringed instrument of FIG. 3.

In the top view of FIG. 5 and FIG. 6, the maximum displacement occurring during a vibration of the string 10 is shown by a dashed line. Due to the substantially parallel orientation of the magnetic axis 80 of the magnetic pickup 21 and the underlying soundboard, the magnetic axis 80 is situated exactly in the vibration plane of the string 10 so that the changes in the magnetic field produced by the magnetic core 40 are very strong and the signal induced in the coil 41 is very large, which signal can be sensed at coil terminals 42.

Figure 7:
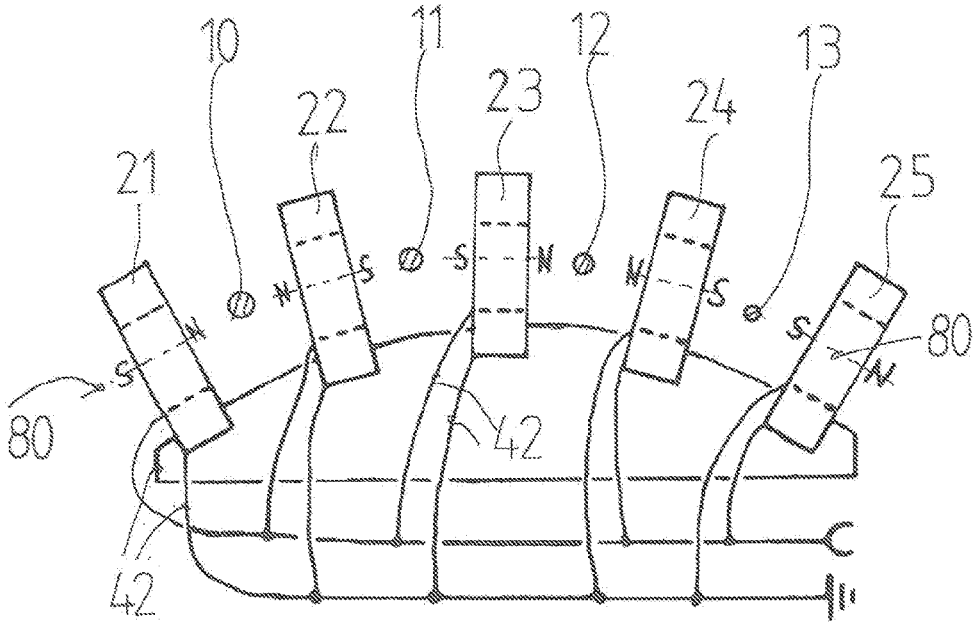
FIG. 7 shows a further detail of the sectional view of the stringed instrument of FIG. 3.

In FIG. 7, the orientation of the poles S, N of the respective magnetic pickups 21, 22, 23, 24, 25 is shown. Each of the four strings 10, 11, 12, 13 is arranged between respective two of the magnetic pickups 21, 22, 23, 24, 25 so that sides of the magnetic pickups 21, 22, 23, 24, 25 facing each other have the same magnetic polarity. In this way, string 11 is e.g. arranged between the magnetic pickups 22, 23, with the sides of the magnetic pickups 22, 23 that face each other having the same magnetic polarity S, S.

The coil terminals 42 of the magnetic pickups 21, 22, 23, 24, 25 are electrically connected in parallel and may for this reason be fed into a single amplifier. The displacements of the strings 10, 11, 12, 13 are picked up in both directions by the respectively adjacent magnetic pickups 21, 22, 23, 24, 25 and converted into an electrical signal, which is then amplified.

Figure 8:
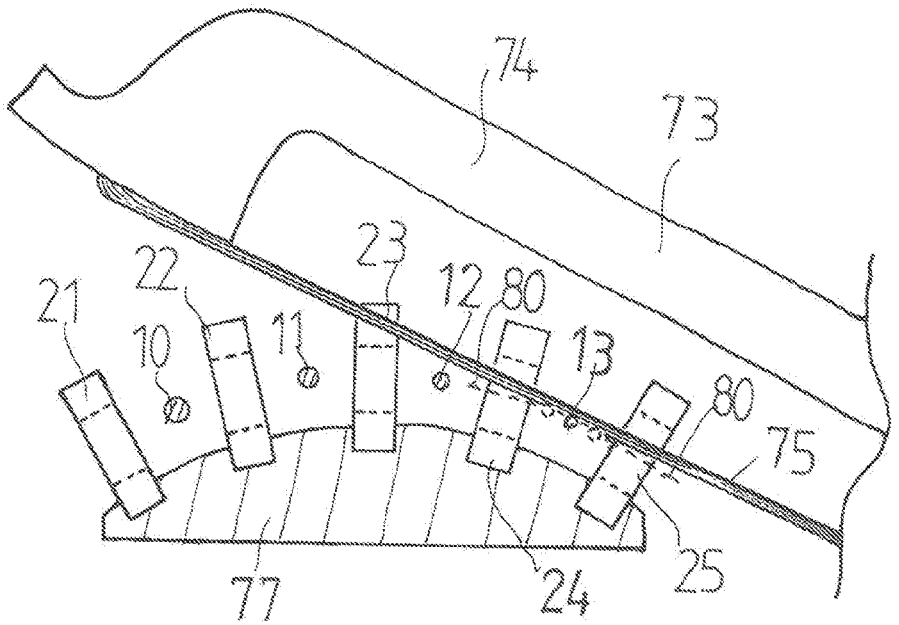
FIG. 8 shows a further detail of the sectional view of the stringed instrument of FIG. 3.

FIG. 8 shows the vibration movement achieved when the string 13 is caused to vibrate by the bow 73, with the magnetic axes 80 of the magnetic pickups 24, 25 being situated approximately in the vibration plane of the string 13.

Figure 9:
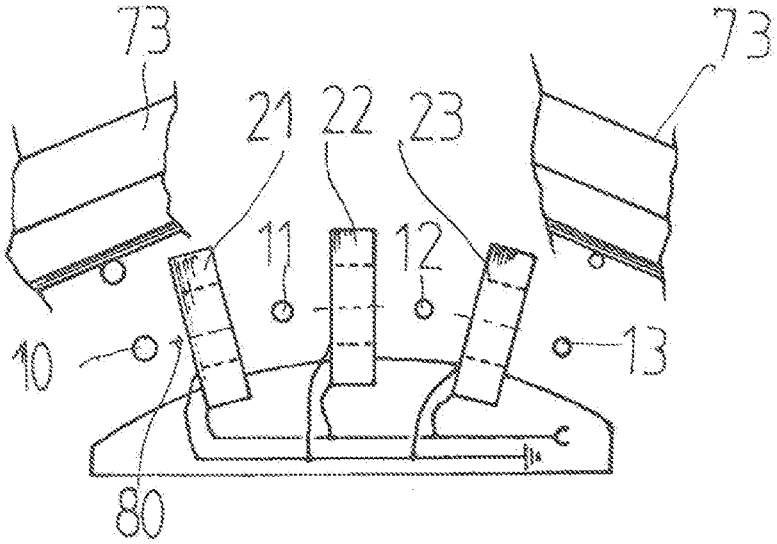
FIG. 9 and FIG. 10 each show a sectional view of further embodiments of the stringed instrument of the invention.

FIG. 9 shows another embodiment of the stringed instrument according to the invention, with four strings 10, 11, 12, 13, 14 and three magnetic pickups 21, 22, 23 being arranged between the strings 10, 11, 12, 13, 14, each having their magnetic axis 80 substantially in parallel to the soundboard 70.

Figure 10:
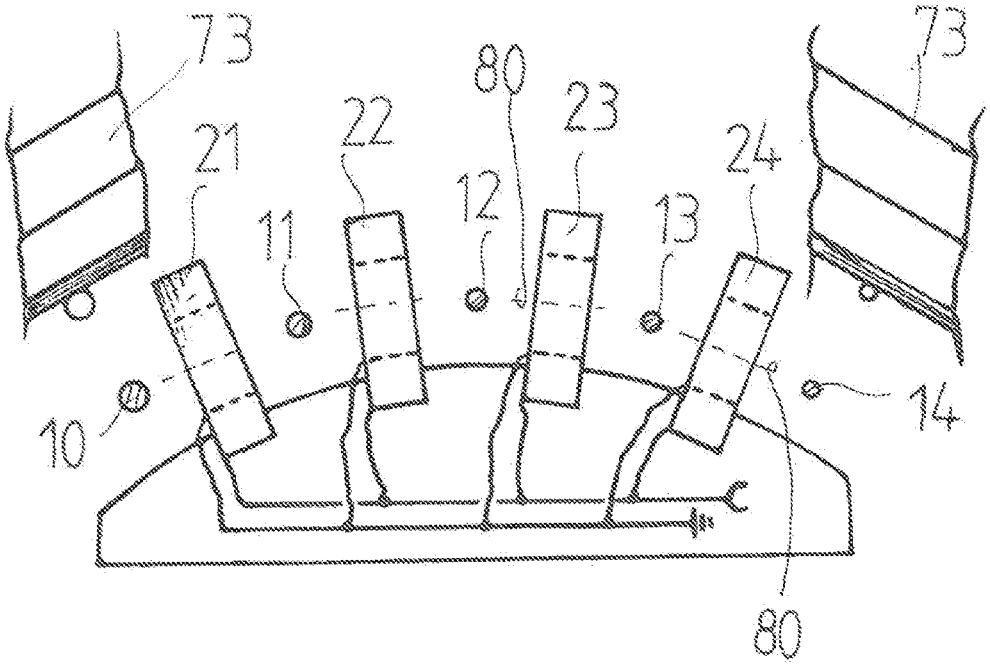
Figure 11:
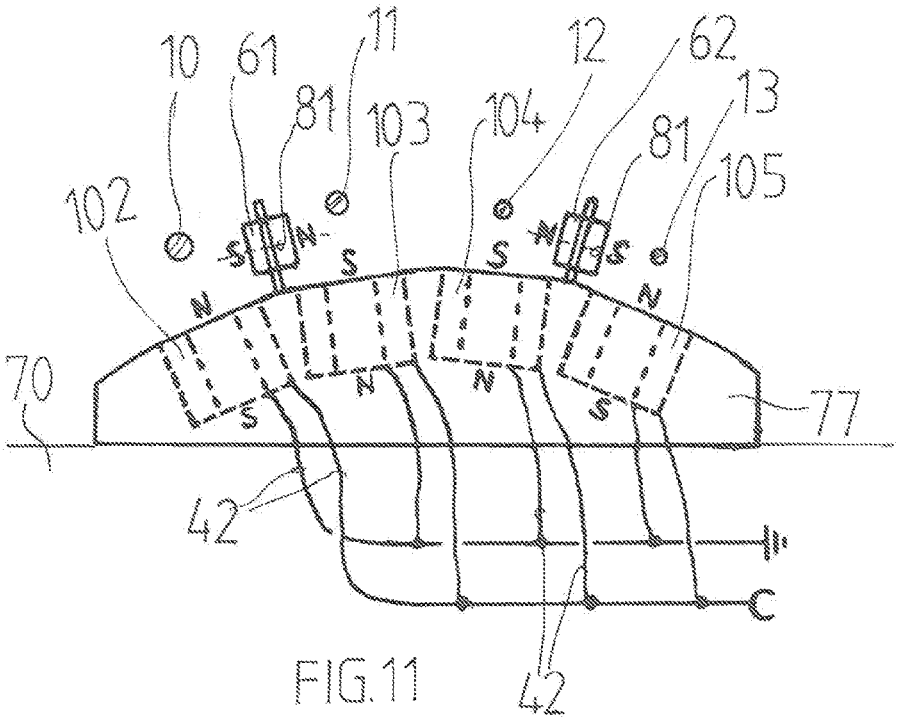
FIGS. 11 to 14 show a sectional view, an oblique view, a top view and a detail of a lateral view of another embodiment of the stringed instrument of the invention.
Figure 12:
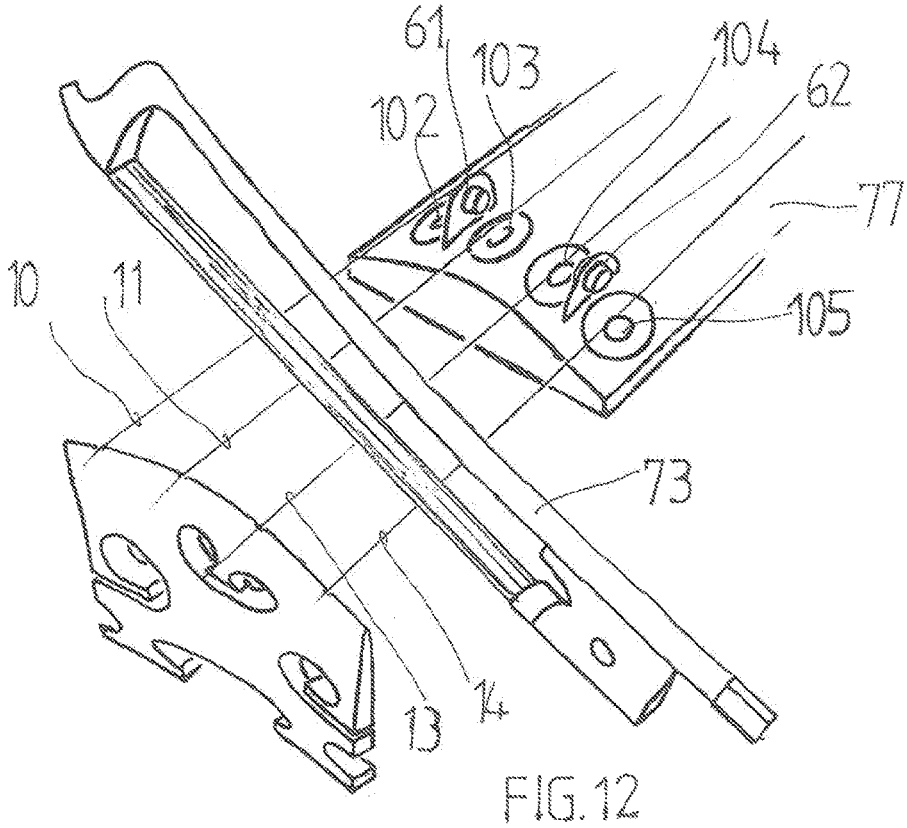
Figure 13:
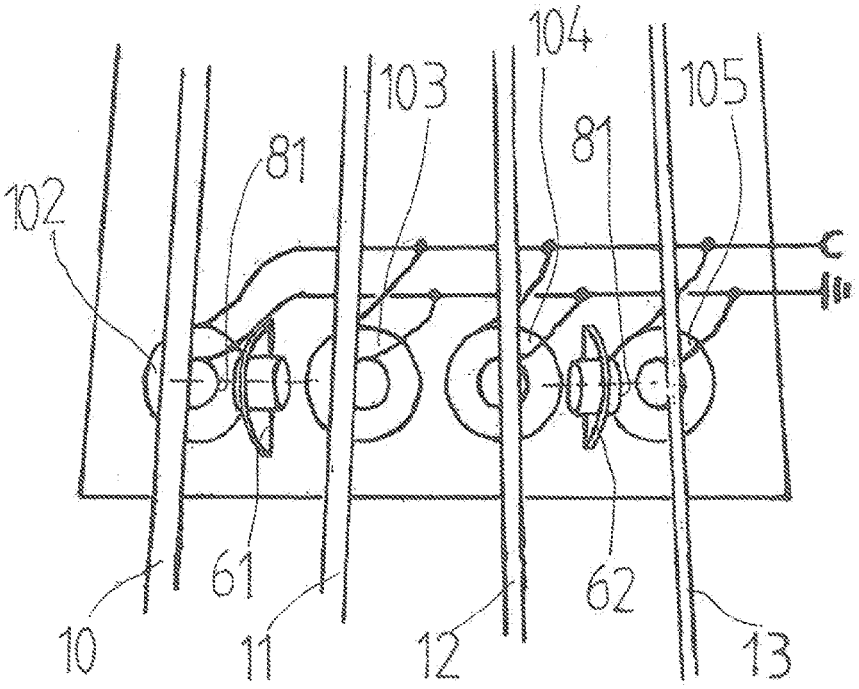
Figure 14:
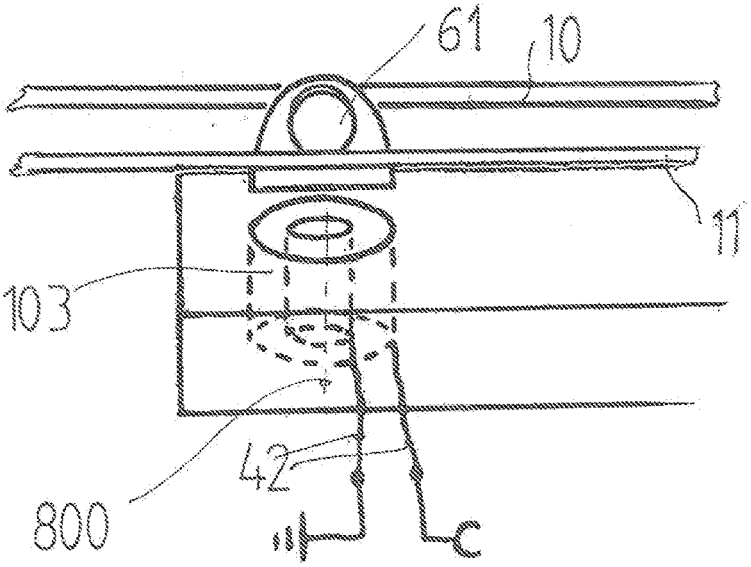

FIG. 10 shows another embodiment of the stringed instrument according to the invention, with five strings 10, 11, 12, 13, 14 and four magnetic pickups 21, 22, 23, 24 arranged between the strings and each having their magnetic axis 80 substantially in parallel to the soundboard 70.

In the further embodiment of the invention as shown in FIGS. 11 to 14, auxiliary magnets 61, 62 are arranged according to the invention in addition to the magnetic pickups 102, 103, 104, 105, which auxiliary magnets have a magnetic axis 81 that is oriented substantially in parallel to the soundboard 70, whereas the magnetic axes of the magnetic pickups 102, 103, 104, 105 are oriented approximately at a right angle to the soundboard 70 in the known manner.

The auxiliary magnets 61, 62 are in the form of permanent magnets, each of cylindrical form, so that the cylinder axis is the magnetic axis.

The magnetic pickups 102, 103, 104, 105 are embedded in a recess of the fretboard 77 underneath the strings 10, 11, 12, 13, 14. Coil terminals 42 are connected in parallel thereto and may be fed into an amplifier (not shown) for amplification of the sensed signal.

A protruding holder is arranged on each side of the strings 10, 11, 12, 13 or between these to attach the auxiliary magnets 61, 62, on which holder the auxiliary magnets 61, 62 are arranged in such a way that their magnetic axis is oriented substantially in parallel to the soundboard 70 or the fretboard 77.

Furthermore, the magnetic axes 81 of the respective auxiliary magnets 61, 62 are oriented substantially at a right angle to the strings 10, 11, 12, 13, 14 (FIG. 12) to ensure that sound generation is as symmetric as possible.

Essentially, the field of the auxiliary magnets 61, 62, which is oriented in the vibration plane of the strings 10, 11, 12, 13, 14, generates a magnetic field component that causes an increase in the pickup signal induced in the magnetic pickups 102, 103, 104, 105.

The invention claimed is:

1. A magnetic pickup for a stringed instrument with at least one string, the stringed instrument comprising a neck part and a body comprising a soundboard or a fretboard, north and south poles of the magnetic pickup defining a magnetic axis, the magnetic pickup comprising:

a permanent-magnet core with a coil wound around the core;

wherein the magnetic axis of the magnetic pickup being oriented substantially in parallel to the soundboard or the fretboard; or wherein the magnetic pickup further comprises:

an auxiliary magnet with a magnetic axis arranged in the region of the magnetic pickup, the magnetic axis of the auxiliary magnet being oriented approximately in parallel to the soundboard or the fretboard or at a right angle to the magnetic axis of the magnetic pickup, wherein the magnetic pickup is embedded in a recess of the soundboard or the fretboard underneath the at least one string, a protruding holder being arranged laterally of the at least one string, on which holder the respective auxiliary magnet is arranged.

2. The magnetic pickup according to claim 1, wherein the magnetic axis of the magnetic pickup is oriented substantially at a right angle to the string.

3. The magnetic pickup according to claim 1, wherein the stringed instrument has two or more strings, the magnetic pickup being arranged between respective two of the strings.

4. The magnetic pickup according to claim 1, wherein the magnetic pickup comprises a cylindrical permanent-magnet core with a coil wound around the magnetic core for picking up a signal, with the cylinder axis being the magnetic axis.

5. The magnetic pickup according to claim 4, wherein the coil is incorporated in a solenoid body formed by a cylindrical tube segment with end flanges, the cylindrical permanent-magnet core being arranged in the tube segment of the solenoid body.

6. The magnetic pickup according to claim 1, wherein the magnetic pickup protrudes from the soundboard or from the fretboard.

7. The magnetic pickup according to claim 1, wherein the at least one magnetic pickup is attached to the fretboard or partially inlaid therein, so that the magnetic axis, when viewed in cross-section, is oriented substantially in parallel to a tangent of the respective part of the curved surface of the fretboard.

8. The magnetic pickup according to claim 7, wherein each of the strings is arranged between respective two of the magnetic pickups so that sides of the magnetic pickups that face each other have the same magnetic polarity.

9. The magnetic pickup according to claim 1, wherein the magnetic axis of the respective auxiliary magnet is oriented substantially at a right angle to the string.

10. The magnetic pickup according to claim 1, wherein the respective auxiliary magnet is a permanent magnet of preferably cylindrical from so that the cylinder axis is the magnetic axis.

11. An electric stringed instrument comprising at least one magnetic pickup for a stringed instrument with at least one string, the stringed instrument comprising a neck part and a body comprising a soundboard, north and south poles of the magnetic pickup defining a magnetic axis, the magnetic pickup comprising:

a permanent-magnet core with a coil wound around the core;

wherein the magnetic axis of the magnetic pickup being oriented substantially in parallel to the soundboard; or wherein the magnetic pickup further comprises:

an auxiliary magnet with a magnetic axis arranged in the region of the magnetic pickup, the magnetic axis of the auxiliary magnet being oriented approximately in parallel to the soundboard or at a right angle to the magnetic axis of the magnetic pickup, wherein the magnetic pickup is embedded in a recess of the soundboard underneath the at least one string, a protruding holder being arranged laterally of the at least one string, on which holder the respective auxiliary magnet is arranged.

12. The electric stringed instrument according to claim 11, wherein the bowed instrument is an electric violin.

* * * * *